US006210550B1

(12) United States Patent
Nidola et al.

(10) Patent No.: US 6,210,550 B1
(45) Date of Patent: Apr. 3, 2001

(54) ANODE WITH IMPROVED COATING FOR OXYGEN EVOLUTION IN ELECTROLYTES CONTAINING MANGANESE

(75) Inventors: Antonio Nidola; Ulderico Nevosi, both of Milan (IT)

(73) Assignee: De Nora S.p.A. (IT)

( * ) Notice: Subject to any disclaimer, the term of this patent is extended or adjusted under 35 U.S.C. 154(b) by 0 days.

(21) Appl. No.: 09/395,828

(22) Filed: Sep. 14, 1999

(30) Foreign Application Priority Data

Oct. 1, 1998 (IT) ..... MI98A2115

(51) Int. Cl.[7] ..... C25B 11/04
(52) U.S. Cl. ..... 204/291; 204/290.14
(58) Field of Search ..... 204/291, 292, 204/293, 290.14

(56) References Cited

U.S. PATENT DOCUMENTS 4,353,790 * 10/1982 Kanai et al. ..... 204/291

* cited by examiner

*Primary Examiner*—Bruce F. Bell
(74) *Attorney, Agent, or Firm*—Bierman, Muserlian and Lucas

(57) ABSTRACT

It is described a novel type of electrode suitable for use as an anode for oxygen evolution from electrolytes containing sulphuric acid, or sulphates, in the presence of manganese, in electrometallurgical processes for the production of zinc, copper, nickel and cobalt and galvanic processes for the deposition of chromium, nickel and noble metals.

The anode of the invention comprises a titanium substrate provided with an electrocatalytic coating for oxygen evolution made of iridium and bismuth oxides. In an alternative embodiment of the invention the coating comprises doping agents selected from the groups IV A, V A and V B, particularly tin and/or antimony.

16 Claims, No Drawings

ANODE WITH IMPROVED COATING FOR OXYGEN EVOLUTION IN ELECTROLYTES CONTAINING MANGANESE

DESCRIPTION OF THE INVENTION

The evolution of oxygen from solutions containing sulphuric acid or sulphates is a well-known reaction. In fact, all electrometallurgical processes based on sulphuric acid or sulphates presently under operation were developed at the beginning of the century. In these processes the anodic counter-reaction to the cathodic deposition or production of metals from the respective salts is represented in fact by the evolution of oxygen.

The industrial processes known so far, where oxygen is evolved at the anode, consist in:

- the electrometallurgy of primary and secondary copper, zinc, cobalt, nickel from sulphuric electrolytes;
- the high speed galvanic deposition of copper and zinc (tapes and wires) and the traditional deposition of chromium, nickel, tin and minor elements.

The most commonly used commercial anode is made of lead or, more precisely, lead alloys (e.g. Pb—Sb; Pb—Ag; Pb—Sn etc.). It consists of a semi-permanent system wherein the lead base undergoes spontaneous modification under anodic polarisation to lead sulphate, $PbSO_4$, (intermediate protective layer with low electrical conductivity) and lead dioxide, $PbO_2$, (semiconducting surface layer relatively electrocatalytic for the oxygen evolution with an electrode potential of >2.0 V (NHE) at 500 $A/m^2$). This system under operation is, on the one hand, immune from progressive or irreversible passivation (spontaneous renewal of the electrodic surface), but, on the other hand, it is subject to the corrosive action of the electrolytic medium, which leads to its increasing dissolution (non-permanent system).

Industrial lead anodes are based on alloys containing, as alloying agents, elements selected from the groups I B, IV A and V A of the periodic table.

Examples of anodic compositions are given in Table 1.

TABLE 1

| Anodic material | Electrometallurgical process |
|---|---|
| Pb—Ag (0.2–0.8%) | Zinc electrometallurgy |
| Pb—Sb (2.6%) | Electrometallurgy of cobalt, nickel, primary and secondary copper |
| Pb—Ag (0.2–0.8%) | |
| Pb—Sn (5–10%) | |

These materials are characterised by:

- high anodic potentials, above 2.0 V (NHE) even at low current densities (e.g. 150 -200 $A/m^2$);
- lifetimes varying from 1 to 3 years;
- High electrical resistivity and high electrical disuniformity (formation under operation of thick and solid layers of $PbSO_4$ (intermediate passivating layer) and $PbO_2$ (electrocatalytic surface layer for oxygen evolution).

This situation negatively affects the cathodic products, which undergo:

- loss of faradic efficiency, never exceeding 90% for the zinc metallurgy and 95%for the cobalt electrometallurgy;
- uneven and dendritic aspect of the deposit, especially for zinc and copper contamination by lead, in the range of 20–40 ppm Pb/ton Zn and 10–30 ppm Pb/ton Co.

As an alternative to lead anodes, cobalt anodes are used for a very limited part of the cobalt electrometallurgy. Three alloys are substantially utilised, corresponding to the following compositions:

Co—Si (5–20%)

Co—Si (5–20%)—Mn (1.0–5.0%)

Co—Si (5–20%)—Cu (0.5–2.5%)

The materials based on cobalt-silicon, as compared to lead, are characterised by a longer lifetime, but at the same time have a lower electrical conductivity and are brittle. The materials based on Co, Si and Cu exhibit values of electrical resistivity similar to those of lead but have a shorter lifetime and in any case are more fragile.

Table 2 summarises the general operating conditions of the prior art materials based on lead and cobalt alloys under the most common electrolytic conditions.

TABLE 2

Prior art anodic materials based on lead and cobalt alloys

| Process | Electrolyte or bath | Current density $A/m^2$ | Anodic material and lifetime (years) Pb—Sn Pb—Sb | Pb—Ag | Co—Si, Co—Si—Mn | Co—Si—Cu |
|---|---|---|---|---|---|---|
| Zinc | $Zn^{2+}$ (40–90 g/l)<br>$H_2SO_4$ (150–200 g/l)<br>Fluorides (50 ppm)<br>Manganese (2–5 g/l) | 300–500 | // | 2–4 | // | // |
| | $Zn^{2+}$ (40–90 g/l)<br>$H_2SO_4$ (150–200 g/l)<br>Fluorides (<5 ppm)<br>Manganese (2–8 g/l) | 300–500 | 1–3 | 2–4 | // | // |
| Cobalt | $Co^{2+}$ (50–80 g/l)<br>$H_2SO_4$ (pH 1.2–1.8)<br>Manganese (10–30 g/l) | 150–250 | 2–3 | 4–5 | 3–4 | 2–3 |
| Primary Copper | $Cu^{2+}$ (40–55 g/l)<br>$H_2SO_4$ (150–200 g/l)<br>Fluorides 100–200 ppm<br>Manganese 300 ppm | 150–200 | 3–4 | — | // | // |

TABLE 2-continued

Prior art anodic materials based on lead and cobalt alloys

| Process | Electrolyte or bath | Current density $A/m^2$ | Anodic material and lifetime (years) Pb—Sn Pb—Sb | Pb—Ag | Co—Si, Co—Si—Mn | Co—Si—Cu |
|---|---|---|---|---|---|---|
| Secondary copper | $Cu^{2+}$ (10–50 g/l) $H_2SO_4$ ≅ (170 g/l) Fluorides ≅ 2–5 ppm | 150–200 | 3–4 | — | // | // |
| Nickel | $Ni^{2+}$ (60–70 g/l) $H_2SO_4$ (pH 2.3–3.0) | 150–200 | 3–4 | | | |

More recently the use of activated titanium anodes has been proposed, comprising a permanent titanium substrate provided with an intermediate protective coating made of oxides and/or noble metals and a surface electrocatalytic coating for oxygen evolution based on tantalum and iridium oxide, more active than lead (electrode potential 1.7 (NHE) at 500 $ANm^2$) and suitable for reactivation ex-situ of the substrate.

This anode is suitable for operation in electrolytes containing sulphuric acid or sulphates free of or scarcely contaminated by impurities, as is the case for some galvanic processes of limited commercial interest. Conversely, at least on the basis of the experience gathered so far, this anode is not suitable for use with electrolytes containing a significant amount of manganese (zinc and cobalt electrometallurgies and some galvanic processes) due to:

i. progressive and irreversible passivation due to the manganese dioxide deposit;

ii. mechanical and chemical attack of the active layer;

iii. loss of noble metal and iv. corresponding loss of faradic efficiency for the cathodic process.

The use of tantalum and iridium oxide, described for the first time in U.S. Pat. No. 3,878,083, arises from the following three reasons:

electrocatalytic activity of iridium and its oxides for the evolution of oxygen with a Tafel slope b<15 mV/decade;

stabilisation of iridium in the oxide state due to the action of tantalum;

structural compatibility between the tantalum and the iridium oxides.

This system is suitable also for concentrated sulphuric electrolytes (e.g. $H_2SO_4$ 150 g/l), provided they are free from impurities and subject to mild conditions in terms of temperature (e.g.<65° C.) and current density (e.g. <5000 $ANm^2$). Under higher current densities (e.g. >5000 $ANm^2$: zinc, copper, chromium electrometallurgies) and/or with electrolytes containing corrosive impurities (fluorides or their derivates and organic compounds in the zinc, copper, chromium electrometallurgies), an interlayer has been added to provide a protective barrier of the titanium substrate against corrosion.

Examples of known compositions of protective interlayers are:

a ) Titanium—Tantalum as oxides, 80-20% on atomic basis respectively. The oxide is formed by thermal decomposition of paints containing suitable precursors, as described in U.S. Pat. No. 4,484,999.

b) Platinum—Iridium in the metal state, 70-30% by weight respectively. Also in this case the layer is obtained by thermal decomposition of paints containing suitable precursor salts, as described in Italian patent application no. MI97A908, filed by the applicant on Apr. 18, 1997.

c) Titanium, tantalum and iridium, and particularly the first two as oxides, the third as metal and/or oxide, 75-20-5% on atomic basis respectively.

As previously said, the tantalum and iridium electrocatalytic coating for oxygen evolution, progressively loses its active properties in sulphuric solutions containing manganese, as is the case with primary copper zinc and cobalt electrometallurgies. In fact, the presence of manganese in the solution involves, in addition to the oxygen evolution reaction, also the electrodeposition of manganese dioxide according to $Mn^{2+}+2H_2O=MnO_2+4H^++2e$ at the anode in a scarcely conducting compact layer. This causes a masking of the original electrocatalytic coating and a gradual passivation whose rate is a function both of the manganese content in the electrolyte and of the temperature.

This ageing mechanism illustrates three main concepts:

concurrence of two reactions, the desired and the parasitic one, whose anodic potentials are very close;

mechanical stability of the $MnO_2$, compact and adhering deposit;

high electrical resistivity of the deposited $MnO_2$ layer.

It has been proposed to modify the coating based on iridium and tantalum oxides by the addition of ruthenium oxide, to decrease the potential for oxygen evolution to values below those of the parasitic reaction, and of titanium oxide in order to achieve the structural stabilisation of ruthenium.

The following compositions have been suggested: Ta—Ir—Ru, 20-75-5% by weight respectively and Ta—Ir—Ru—Ti, 17,5-32,5-32,5-17,5% by weight respectively.

The above described anodes, provided with the protective interlayer and the electrocatalytic coating containing ruthenium and titanium, have found only experimental and not yet satisfactory applications so far. These applications are summarised in table 3.

TABLE 3

Classification of industrial processes using experimental activated titanium anodes

| PROCESS Definition | Operating conditions | | ACTIVATED TITANIUM ANODE DESCRIPTION Interlayer | Surface coating |
|---|---|---|---|---|
| Electrolytic production of copper (primary) | Temperature | ≅45° C. | Pt Ir or TiTaOx | TaIrOx or TaTiIrRuOx |
| | Anodic current density $A/m^2$ | 150–200 | | |
| | Cu | 40–55 g/l | | |
| | $H_2SO_4$ | 150–200 g/l | | |
| | Mn ppm | 30–300 | | |

TABLE 3-continued

| Classification of industrial processes using experimental activated titanium anodes | | | | |
|---|---|---|---|---|
| | | | ACTIVATED TITANIUM ANODE DESCRIPTION | |
| PROCESS | | | | Surface |
| Definition | Operating conditions | | Interlayer | coating |
| | F ppm | 100–200 | | |
| Copper refining (secondary copper exhaustion cells) | Temperature | 30–34° C. | Ti – TaOx + IrOx or Pt – Ir | TaIrOx or |
| | Anodic current density A/m$^2$ | 150–200 | | |
| | $H_2SO_4$ | 10–50 g/l ≅170 g/l | | |
| Chromium deposition from sulphate + fluoride | Temperature | 55–65° C. | TiTaOx + IrOx | TaIrOx |
| | Anodic current density A/m$^2$ | 2500–6000 | | |
| | $CrO_3$ | 250–300 g/l | | |
| | $H_2SO_4$ | 1,0–1,5 g/l | | |
| | $H_2SiF_6$ | 1,0–1,5 g/l | | |
| Chromium deposition from sulphate + organics | Temperature | 55–65° C. | TiTaOx + IrOx | TaIrOx |
| | Anodic current density A/m$^2$ | 2500–6000 | | |
| | $CrO_3$ | 250–300 g/l | | |
| | $H_2SO_4$ | 1,5–2,5 g/l | | |
| | $C_2H_5SO_3H$ ppm | 100–1000 | | |

The present invention is directed to overcoming the drawbacks still affecting the experimental anodes previously described which mainly consist in the deposition of manganese dioxide and/or the corrosion of the titanium substrate, even if remarkably delayed in time.

In particular, the present invention is directed to an anode for oxygen evolution in electrochemical processes carried out with electrolytes containing sulphuric acid or sulphate, metals to be deposited at the cathode, high quantities of manganese and, in some cases, limited concentrations of fluorides (<5 ppm). The anode of the invention comprises a titanium substrate provided with an electrocatalytic and selective layer for oxygen evolution and is unaffected by the parasitic reaction of electrochemical precipitation of non-conductive manganese dioxide. The main components of the electrocatalytic layer are iridium oxide, which acts as electrical conductor and catalyst for oxygen evolution, and bismuth oxide, electrically non-conductive and directed to stabilise iridium. The coating may comprise doping agents selected from the groups IVA (e.g. Sn), VA (e.g. Sb), VB (e.g. Nb and Ta), as promoters of both the electronic conductivity and compactness of the coating. In a different embodiment of the invention, the anode may comprise one or more protective interlayers applied between the titanium substrate and the coating. The interlayer, the components of which are selected in the groups IV B (e.g. Ti), V B (e.g. Ta), VIII2 (e.g. Ir), VIII3 (e.g. Pt), acts as a protective barrier for the titanium substrate against corrosion.

The anode exhibits the following operating characteristics:

- anodic potentials for oxygen evolution close to the reversible value also under high current density (e.g. 1.65 V (NHE) at 3000 A/m$^2$);
- high overvoltage for the deposition of $MnO_2$; this reaction is practically inhibited also with high concentrations of manganese (e.g. Mn>5 g/l) and temperatures up to 60° C.;
- chemical and mechanical stability of the coating under operating conditions;
- Faradic efficiencies of the cathodic process of metal deposition higher than those of the prior art anodes (lead anodes and anodes of titanium provided with a coating made of iridium and tantalum oxides).

The invention will be now described making reference to some examples. which are not intended to be a limitation thereof. The samples were made of titanium grade 2 with dimensions of 10 mm×50 mm×2 mm, subjected to mechanical sandblasting with corindone (grain dimensions 0.25–0.35 mm average), at a pressure of 5–7 atm, with a distance between the sample and the nozzle of 20–30 cm. The paint comprised hydro-soluble chlorides as precursor salts. In particular, the following salts or solutions have been used, suitably mixed as explained hereinafter:

| | |
|---|---|
| $H_2Ir\ Cl_6$ | 20–23% solution as Ir |
| $TaCl_5$ | hydrochloric solution 50 g/l as Ta |
| $BiCl_3$ | salt or slightly hydrochloric solution at 50 g/l as Bi |
| $SnCl_2 2H_2O$ | salt or hydrochloric solution at 10 g/l as Sn |
| $SbCl_3$ | salt or hydrochloric solution 10 g/l as Sb |
| $NbCl_5$ | salt or hydrochloric solution 10 g/l as Nb |

The following painting procedure was used:

- application of the aqueous solution containing the precursor salts of the various components in the defined ratio, by brushing or equivalent technique (e.g. rolling, electrostatic spraying);
- drying at 105° C., thermal decomposition for 15 minutes at 490° C. in oven under forced air ventilation;
- repeating of the painting and thermal cycle until the pre-defined amount of noble metal in the final coating is obtained;
- annealing at 510° C.

The samples thus obtained have been subjected to electrolysis as anodes in the solutions reported in Table 4.

TABLE 4

| Anodic Electrochemical Characterisation | | | | | | |
|---|---|---|---|---|---|---|
| | Type of solution and operating conditions of the test | | | Relevant Industrial Applications | | |
| Reference process | Code | Description | | Specific process | Industrial operating conditions | |
| Electrolysis of sulphuric | A | $H_2SO_4$ | 170 g/l | electrolytic production of | pH | 1.2–1.8 |
| | | Mn | 4 g/l | | Co | 50–80 g/l |

TABLE 4-continued

| Anodic Electrochemical Characterisation | | | | | | |
|---|---|---|---|---|---|---|
| Reference process | Type of solution and operating conditions of the test: Code | Description | | Relevant Industrial Applications: Specific process | Industrial operating conditions | |
| solutions containing manganese | | temp. | 40° C. | cobalt | Mn | 15 g/l |
| | | current density | 500 A/m$^2$ | | temp. | 60° C. |
| | | | | | current density | 200 A/m$^2$ |
| | | | | electrolytic production of copper (primary copper) | $H_2SO_4$ | 180 g/l |
| | | | | | Cu | ≅50 g/l |
| | | | | | Mn | <300 ppm |
| | | | | | temp. | ≅50° C. |
| | | | | | current density | ≅200 A/m$^2$ |
| | | | | electrolytic production of zinc (<90% of the world-wide electrolytic production) | $H_2SO_4$ | 180 g/l |
| | | | | | Zn | 70 g/l |
| | | | | | Mn | 4 g/l |
| | | | | | temp. | <40° C. |
| | | | | | current density | 500 A/m$^2$ |
| Electrolysis of sulphuric solutions containing manganese | B | as above + $ZnSO_4$ | (Zn 70 g/l) | | | |
| | | Fluorides | <5 ppm | | | |

EXAMPLE 1

8 samples of titanium, pre-treated as described above, have been activated by different coatings selected among the most representative of the prior art, according to the above described procedure.

The final compositions of the prepared samples and the corresponding code numbers are specified in table 1.1. The percentages are expressed by weight and refer to the components in the elemental state.

TABLE 1.1

| Description of the reference samples | | | | | | | | | |
|---|---|---|---|---|---|---|---|---|---|
| Code | Protective interlayer | | | | Electrocatalytic coating | | | | |
| (°) No. | Ti | Ta | Ir | Ir | Ta | Ir | Ti | Ru | Ir + Ru |
| | % molar | | | g/m$^2$ | % by weight | | | | g/m$^2$ |
| 5.1.1 | 80 | 20 | // | // | 35 | 65 | // | // | 10 |
| 5.1.2 | 80 | 20 | // | // | 17,5 | 32,5 | 17,5 | 32,5 | 10 |
| 5.1.3 | 75 | 20 | 5 | 1 | 35 | 65 | // | // | 10 |
| 5.1.4 | 75 | 20 | 5 | 1 | 17,5 | 32,5 | 17,5 | 32,5 | 10 |

(°) Each code number corresponds to two samples having the same formulation.

TABLE 2.1

| Description of the samples of the invention | | | | | | |
|---|---|---|---|---|---|---|
| | Coating components | | | | | |
| Code N. | Ir % | Bi % | Sn % | Sb % | Ta % | Nb % |
| 5.2.1 | 65 — | 35 | | | | |
| 5 2.2 | 65 | 30 | | | 5 | |
| 5.2.3 | 65 | 17,5 | | | 17,5 | |
| 5.2.4 | 65 — | 30 | 5 | | | |
| 5.2.5 | 65 | 25 | 10 | | | |
| 5.2.6 | 65 | 25 | 5 | 5 | | |
| 5.2.7 | 65 | 30 | | 5 | | |
| 5.2.8 | 65 — | 30 | | | | 5 |

EXAMPLE 2

This example concerns anodic materials of titanium activated with the coating of the invention based on bismuth and iridium oxides with and without doping agents.

8 samples of titanium, pretreated as described above, have been activated with different coatings whose code numbers and final compositions expressed in percentages by weight with respect to the components in the elemental state are reported in table 2.1.

For all the samples the iridium content was 10 g/m$^2$. The samples were tested as anodes in sulphuric electrolyte containing manganese, as an impurity, under the operating conditions described in table 4 for the electrolyte code A. The anodic potential with time and visual observations of the morphological state of the coatings at the end of the test are reported in table 2 and compared with the data obtained with the prior art samples prepared by procedure described in example 1.

TABLE 2.2

| Code N. | Electrochemical behaviour of the tested samples (Electrolyte code: A) Anodic Potential: V (NHE) Initial | 1000 h | 2000 h | 3000 h | FINAL MORPHOLOGICAL STATE |
|---|---|---|---|---|---|
| | ANODES OF THE INVENTION | | | | |
| 5.2.1 | 1,68 | 1,72 | 1,75 | 1,77 | $MnO_2$ deposit in a highly distributed form, undetermined |
| 5.2.2 | 1,68 | 1,72 | 1,83 | 1,94 | Thin and porous $MnO_2$ deposit |
| 5.2.3 | 1,68 | 1,78 | 1,87 | 1,95 | Thin and porous $MnO_2$ deposit |
| 5.2.4 | 1,68 | 1,75 | 1,77 | 1,85 | Extremely thin $MnO_2$ deposit |
| 5.2.5 | 1,67 | 1,78 | 1,87 | 1,92 | $MnO_2$ deposit unevenly distributed (zones) |
| 5.2.6 | 1,68 | 1,75 | 1,78 | 1,95 | Thin and porous $MnO_2$ deposit |
| 5.2.7 | 1,68 | 1,79 | 1,80 | 1,94 | $MnO_2$ deposit unevenly distributed (zones) |
| 5.2.8 | 1,68 | 1,74 | 1,85 | 1,97 | Thin and porous $MnO_2$ deposit |
| | PRIOR ART ANODES | | | | |
| 5.1.1 | 1,62 | 1,98 | 2,08 | 2,15 | Compact $MnO_2$ deposit |
| 5.1.2 | 1,65 | 1,76 | 2,00 | 2,05 | $MnO_2$ deposit in scales |
| 5.1.3 | 1,64 | 2,00 | 2,07 | 2,12 | Compact $MnO_2$ deposit |
| 5.1.4 | 1,65 | 1,76 | 1,97 | 2,06 | $MnO_2$ deposit in scales |

The experimental results of Table 2.2 show that:

all the prior art samples are passivated when manganese is present in the solution: in particular, passivation is quick for the coatings without ruthenium (a few hundred hours); passivation is less quick but nevertheless significant and irreversible for the coatings containing ruthenium (a thousand hours as a maximum).

None of the samples of the invention exhibits any passivation after more than 3000 hours of operation in solutions containing manganese. In particular, coatings containing tantalum or niobium are covered with a thin and porous, mechanically inconsistent layer, which is removed under operation. The coatings without tantalum or niobium did not give rise to macroscopic precipitates of $MnO_2$ for the whole electrolysis period.

EXAMPLE 3

This example concerns the use of anodes, provided with a protective interlayer and an electrocatalytic coating used in industrial sulphuric electrolytes for the production of zinc containing fluorides and manganese. N. 16 samples of titanium pre-treated as described above have been activated with different coatings based on bismuth, iridium with and without doping agents. In particular, a first series of samples identified by code no. 5.3 was without the interlayer; a second series of samples identified by code no. X 5.3 comprised a protective interlayer made of noble metals only in the elemental state; a third series of samples, identified by code no. Y 5.3 comprised a protective interlayer made of valve metal oxides containing small quantities of noble metals. The code numbers and the final compositions of the coatings, expressed as percentages by weight relative to all the components in the elemental state are reported in table 3.1. For all the samples the iridium loading was 10 g/m$^2$.

TABLE 3.1

| Code No. | Description of the coatings and relevant codes — Components of the coatings: Protective Interlayer Ti % | Ta % | Ir % | Pt % | Electrocatalytic Coating Bi % | Sn % | Sb % | Ta % | Nb % | Ir % |
|---|---|---|---|---|---|---|---|---|---|---|
| 5.3.1 | | | | | 35 | // | // | // | // | 65 |
| 5.3.2 | | | | | 30 | | | 5 | | 65 |
| 5.3.3 | | | | | 17,5 | | | 17,5 | | 65 |
| 5.3.4 | | | | | 30 | | | | 5 | 65 |
| 5.3.5 | | | | | 30 | 5 | | | | 65 |
| 5.3.6 | | | | | 25 | 10 | | | | 65 |
| 5.3.7 | | | | | 30 | | 5 | | | 65 |
| 5.3.8 | | | | | 25 | 5 | 5 | | | 65 |
| X5.3.1 | | | 30 | 70 | 35 | | | | | 65 |
| X5.3.2 | | | 30 | 70 | 30 | | | 5 | | 65 |
| X5.3.5 | | | 30 | 70 | 30 | 5 | | | | 65 |
| X5.3.8 | | | 30 | 70 | 25 | 5 | 5 | | | 65 |
| Y5.3.1 | 75 | 20 | 5 | | 35 | | | | | 65 |
| Y5.3.2 | 75 | 20 | 5 | | 30 | | | 5 | | 65 |
| Y5.3.5 | 75 | 20 | 5 | | 30 | 5 | | | | 65 |
| Y5.3.8 | 75 | 20 | 5 | | 25 | 5 | 5 | | | 65 |

The samples have been tested as anodes in an electrolyte for the production of zinc, under the electrolytic and operating conditions of Table 4, electrolyte code C. The test comprised the use of transparent plastic lab cells, each one comprising:

an anode as previously described;

a counter-electrode with dimensions of 10 mm×50 mm×2 mm;

a dosing pump for the circulation of the solution;

The electrolyte was partially renewed every 24 hours.

The results obtained with the anodes of the invention, that is anodic potential with time, zinc yield (determined by removal of cathode every 48 hours and relevant weighing) and visual observations of the morphological state of the coating at the end of the test are reported in table 3.2.

These data are compared with the data obtained with the prior art anodes, prepared according to the procedure described in Example 1.

TABLE 3.2

| Code | Electrochemical Behaviour (Electrolyte code: B) Anodic Potential: V (NHE) | | | | Zinc deposition faradic Yield (average | Final morphological |
|---|---|---|---|---|---|---|
| No. | Initial | 1000 h | 2000 h | 3000 h | values) % | observations |
| 5.3.1 | 1,67 | 1,72 | 1,83 | 1,87 | 90–92 | $MnO_2$ deposit, undetermined |
| 5.3.2 | 1,67 | 1,73 | 1,85 | 1,87 | 90–92 | $MnO_2$ deposit, undetermined |
| 5.3.3 | 1,68 | 1,73 | 1,84 | 1,88 | 90–92 | $MnO_2$ deposit, undetermined |
| 5.3.4 | 1,68 | 1,73 | 1,86 | 1,88 | 90–92 | $MnO_2$ deposit, undetermined |
| 5.3.5 | 1,68 | 1,73 | 1,85 | 1,88 | 90–92 | $MnO_2$ deposit, undetermined |
| 5.3.6 | 1,68 | 1,73 | 1,86 | 1,9 | 90–92 | Thin and unevenly distributed $MnO_2$ deposit (in zones) |
| 5.3.7 | 1,69 | 1,73 | 1,87 | 1,9 | 80–83 | Thin and unevenly distributed $MnO_2$ deposit (in zones) |
| 5.3.8 | 1,68 | 1,75 | 1,87 | 1,9 | 80–82 | Thin and unevenly distributed $MnO_2$ deposit (in zones) |
| X5.3.1 | 1,68 | 1,76 | 1,81 | 1,87 | 90–92 | $MnO_2$ deposit, undetermined |
| X5.3.2 | 1,68 | 1,80 | 1,81 | 1,87 | 90–92 | $MnO_2$ deposit, undetermined |
| X5.3.5 | 1,68 | 1,8 | 1,81 | 1,9 | 90–92 | Thin and unevenly distributed $MnO_2$ deposit (in zones) |
| X5.3.8 | 1,68 | 1,81 | 1,87 | 1,9 | 90–92 | Thin and unevenly distributed $MnO_2$ deposit (in zones) |
| Y5.3.1 | 1,68 | 1,77 | 1,81 | 1,87 | 90–92 | $MnO_2$ deposit, undetermined |
| Y5.3.2 | 1,68 | 1,78 | 1,81 | 1,99 | 90–92 | Thin and unevenly distributed $MnO_2$ deposit (in zones) |
| Y5.3.5 | 1,68 | 1,78 | 1,88 | 1,94 | 80–82 | Thin and unevenly distributed $MnO_2$ deposit (in zones) |
| Y5.3.8 | 1,68 | 1,77 | 1,82 | 1,84 | 81–83 | Thin and unevenly distributed $MnO_2$ deposit (in zones) |
| 5.1.1 | 1,65 | 2,05 | | | –90 | Thick and compact $MnO_2$ deposit |
| 5.1.2 | 1,65 | 1,73 | 1,84 | | –82 | Thick and compact $MnO_2$ deposit |
| 5.1.3 | 1,65 | 2,0 | | | 90 | Thick and compact $MnO_2$ deposit |
| 5.1.4 | 1,64 | 1,74 | 1,87 | | 79 | Thick and compact $MnO_2$ deposit |

The results reported in Table 3.2 permit to state that:

All prior art anodes passivated in sulphuric solutions containing at the same time fluorides, manganese and precursor salts of zinc. The average faradic yield of zinc deposition with the prior art anodes is lower than 90% as an average.

The samples of the invention do not exhibit any passivation phenomena after 3000 hours of electrolysis in industrial solutions containing at the same time fluorides, manganese and zinc precursor salt. The faradic yield in the average is higher than 90%.

What is claimed is:

1. An anode for oxygen evolution in electrolytic processes in electrolytes containing at least one member of the group consisting of sulphuric acid and metal sulphates to be deposited at the cathode and high quantities of manganese and optionally <5 ppm fluorides comprising a titanium substrate provided with an electrocatalytic coating based on oxides of iridium and bismuth.

2. The anode of claim 1 characterized in that said electrocatalytic coating further comprises oxides of the metals of groups IV A, VA and VB.

3. The anode of claim 2 characterized in that said metals of groups IVA, VA and VB are respectively tin, antimony, tantalum and niobium.

4. The anode of claim 3 characterized in that bismuth and iridium are the main components while tin, antimony, tantalum and niobium are minor components.

5. The anode of claim 4 wherein the quantity of iridium is in the range of 55–80% bismuth is in the range of 45–20%, antimony and tin in the range of 2.5–10%, tantalum and niobium in the range of 2.5–7.5%, all based on total weight.

6. The anode of claim 4 wherein the amount of iridium is between 60 to 65%, bismuth is between 40 to 25%, antimony and tin in the range of about 5% and tantalum and niobium in about 5%, all based on total weight.

7. The anode of claim 1 comprising at least one protective interlayers of the titanium substrate, made of oxides selected from the group consisting of the oxides of groups IVB, VB, VA and VIII.

8. The anode of claim 7 wherein the metals of group IVB, VB, VA and VIII are titanium, tantalum and iridium.

9. The anode of claim 8, wherein titanium and tantalum are in a ratio of 4:1 by weight and constitute 97.5-90, % by weight referred to the elements and iridium, as the minor component, constitutes 2.5-10, % by weight referred to the element.

10. The anode of claim 9 wherein the content of noble metal in the electrocatalytic coating is comprised between 14 and 32 $g/m^2$, while the total content of noble metal in the interlayer is comprised between 0.5–5.0 $g/m^2$.

11. The mode of claim 10 wherein the content of noble metal in the coating is 20 to 24 $g/m^2$and the content of noble metal in the interlayer is 1 to 3 $g/m^2$.

12. The anode of claim 9 wherein the titanium and tantalum are about 95% by weight and iridium is about 5% by weight.

13. The anodes of claim 1 comprising a protective interlayer for the titanium substrate made of platinum and iridium in a ratio of 70-30% by weight.

14. A method for preparing the anode of claim 1 comprising a) corindone sandblasting of the titanium substrate;

b) pickling the substrate in azeotropic hydrochloric acid;

c) forming the protective interlayer by applying paints containing precursor salts of the metals of the platinum group and metals of the groups IVB, VB, VA and VIII, drying and thermal decomposition under forced air ventilation; repetition of the above steps to obtain the desired content of noble metal;

d) forming the electrocatalytic coating by applying paints containing precursor salts of the metals of the platinum group, non noble metals of group VA, non noble metals of group IV A, non noble metals of group V B, drying and thermal decomposition under forced air ventilation; repetition of the above steps to obtain the desired content of noble metal.

15. In a method of electroplating a metal from an aqueous solution of the metal, the improvement comprising using an anode of claim 1.

16. The method of claim 15 wherein the metal is zinc or cobalt.

* * * * *